United States Patent [19]

Weiss

[11] 4,369,724

[45] Jan. 25, 1983

[54] WINGSAIL

[76] Inventor: John Weiss, 873 Arctic St., Lindenhurst, N.Y. 11757

[21] Appl. No.: 175,503

[22] Filed: Aug. 5, 1980

[51] Int. Cl.[3] ..... B63B 15/02

[52] U.S. Cl. ..... 114/39; 114/97; 114/103

[58] Field of Search ..... 114/39, 89, 90, 102, 114/103, 97, 98, 99, 100, 91; 9/310 E

[56] References Cited

U.S. PATENT DOCUMENTS 3,598,075 8/1971 Kenney ..... 114/102

FOREIGN PATENT DOCUMENTS 2702642 8/1978 Fed. Rep. of Germany ..... 114/102
2803957 8/1979 Fed. Rep. of Germany ..... 114/103
2912867 10/1980 Fed. Rep. of Germany ..... 114/102
1464877 1/1967 France ..... 114/103
2275360 1/1976 France ..... 114/39

*Primary Examiner*—Trygve M. Blix
*Assistant Examiner*—Stephen P. Avila
*Attorney, Agent, or Firm*—Frishauf, Holtz, Goodman & Woodward

[57] ABSTRACT

A low drag and high lift sail has a fabric skin suspended by an edge tension device able to control forward and trailing edge tension to tune and reverse the airfoil section. The fabric skin is double, with a windward and lee section of different curvatures giving the airfoil section thickness. The sail is supported by a mast and a curved boom located between the two fabric sections and thus is out of the impinging air stream. The ends of the boom are used for the sail support, usually with an additional external spar or spars on the windward side. The mast includes a foot which is either fixed or attached by a universal joint to a craft for motive power.

11 Claims, 8 Drawing Figures

WINGSAIL

This invention relates to flexible wing sails for motive power, particularly to sails having reversible shape to form a lifting thick section airfoil in either direction. A reversable sail is one in which the leading edge becomes the trailing edge after tacking.

BACKGROUND OF THE INVENTION

The efficiency of sails and sail systems depend upon the relation of two forces namely lift and drag. All attempts to increase the performance of sails have been aimed at increasing the lift force to drag force ratio. By increasing the lift through better aerodynamic shape, or decreasing the drag by streamlining better sails have been developed. In addition to the drag associated with the airfoil section of the sail there is an additional drag from the supporting structure that will typically reduce the efficiency of the entire sail system. Supporting structures include masts, booms, spars and cables which all cause additional drag and tend to lower the lift to drag ratio of the sail system.

Various attempts have been made to lower the drag imparted to the sail system by the supporting structures. Masts, normally attached to the leading edge, cause a turbulent wake that disturbs the airflow to the sail and reduces aerodynamic lift and causes drag. One method used on many high performance sailboats has been to streamline the mast and allow rotation so that the narrowest section is across the impinging air flow. The extreme of this approach is called the wing mast, a rigid mast section, having up to 25% of the total sail area, has a flexible fabric sail cloth attached at its trailing edge to form the remaining portion of the sail. The increased efficiency is a result of having thickness in the airfoil section much the same as on an airplane wing, the intersection between the wing mast and the fabric portion however is not a smooth junction and thus some drag is still inherent. Other improvements extending from the wing mast approach has been the development of total rigid airfoil sails, (ex. Barkla U.S. Pat. No. 2,804,038 and Smith U.S. Pat. No. 3,295,487).

Another approach has been to have a freely hanging sail away from the mast, as are conventional jibs and genoas, and eliminate the mast turbulent effect on the airfoil, (eg. Darby "Popular Science" August 1965 pages 138–141 and Jamieson U.S. Pat. No. 4,044,702). The mast drag still remains although drag reduction can be accomplished by covering the mast with a rotatable streamlined fairing.

These developments have succeeded to reduce the drag effect of the supporting structures however they all have inherent disadvantages. The wing mast and solid wing structure is the airfoil and is very heavy and thus causes additional drag on the vehicle or craft being propelled. The triangular freely hanging sails are relatively high for sails having areas equal to sails with masts at the forward edge because of the inward curves of the edge tension and support elements, hence the masts to support such must be even higher than the sails they suspend and therefore add a considerable amount of drag to the sail system.

It is my invention to "eliminate" the drag associated with the sail support structure and to increase the airfoil lift by enclosing the structure within a double fabric high lift airfoil section.

SUMMARY OF THE INVENTION

It is the object of this invention to provide sail for vehicles such as ice boats, sailboats, multihull boats, land craft, and sailboards for increased speed and upwind performance.

The sail comprises two symetric fabric sections attached together at the edges and supported by an internal arrangement of a mast and curved boom. Cables run through pockets at the edge attachment points to hold the fabric out stretched and are terminated at the head and foot of the sail. A mast head device connects the internal mast and edge tension cables at the top of the sail, this device also forms the desired elliptic airfoil tip. The cables are attached at the tack and clew of the sail to fittings on the ends of the internal curved boom and terminate at the foot of the sail to the lower mast end. A control rope is attached to the mast at the internal mast boom connection, the boom is slideably connected to the mast, and runs to each end of the internal boom. This control rope is tensioned and the mast moves either direction along the boom to set up a differential between the cable tensions in one edge of the sail relative to the other edge. The curve of the leading edge becomes taught while the curve of the trailing edge slackens to form direction to the airfoil shape. The control rope is pulled to either end of the boom in sequence with tacking to provide the optimum airfoil shape in either direction.

In the preferred embodiment the sail is adapted for windsurfing by providing a spar attached to the end of the internal boom for hand holding. This spar is external and to windward of the sail. The foot of the mast is connected to a universal or flexible joint attached to the modified surfboard. The shape control rope runs along the external spar and is cleated to a convenient location near each end of the spar. A symetric airfoil that has flexibility will take on a non symetric airfoil shape due to the leeside pressure distribution of the sail and for simplicity the airfoil shape will reverse to some degree without differential cable adjustment.

This arrangement the boom forms a familiar wishbone boom with the spar, the boom internal within the airfoil section and the spar external to windward of the sail and is the only element outside of the sail and subjected to aerodynamic drag.

Another embodiment includes the sail attached to a double ended proa. The mast is rotatably stepped on the long hull that is always to leeward of the shorter, outrigger, hull. The ends of the internal boom are attached to control spars that slideably attach to the cross beams between the hulls. The control spars support the sail and control the sheeting angle. On larger versions a stay or set of stays are hooked to the head piece of the sail along the center line of rotation. The boat is sailed in the usual manner for a reversible proa. In addition, as in the preferred embodiment, a differential cable tension control can be used to directionalize the airfoil shape of the sail.

DETAILED DESCRIPTION OF THE INVENTION

In the preferred embodiment the sail is connected to a sailboard, large modified surfboard, through a universal or flexible joint, the sail is free to fall in any direction. In this preferred embodiment the greatest advantage of a high lift sail is utilized. When the sail is angled to windward the lift vector has an upward component. This upward component counteracts the weight of the sailor and the sailboard and as a result reduced drag and enhanced plaining increase the speed of the sailboard.

Figure 1:
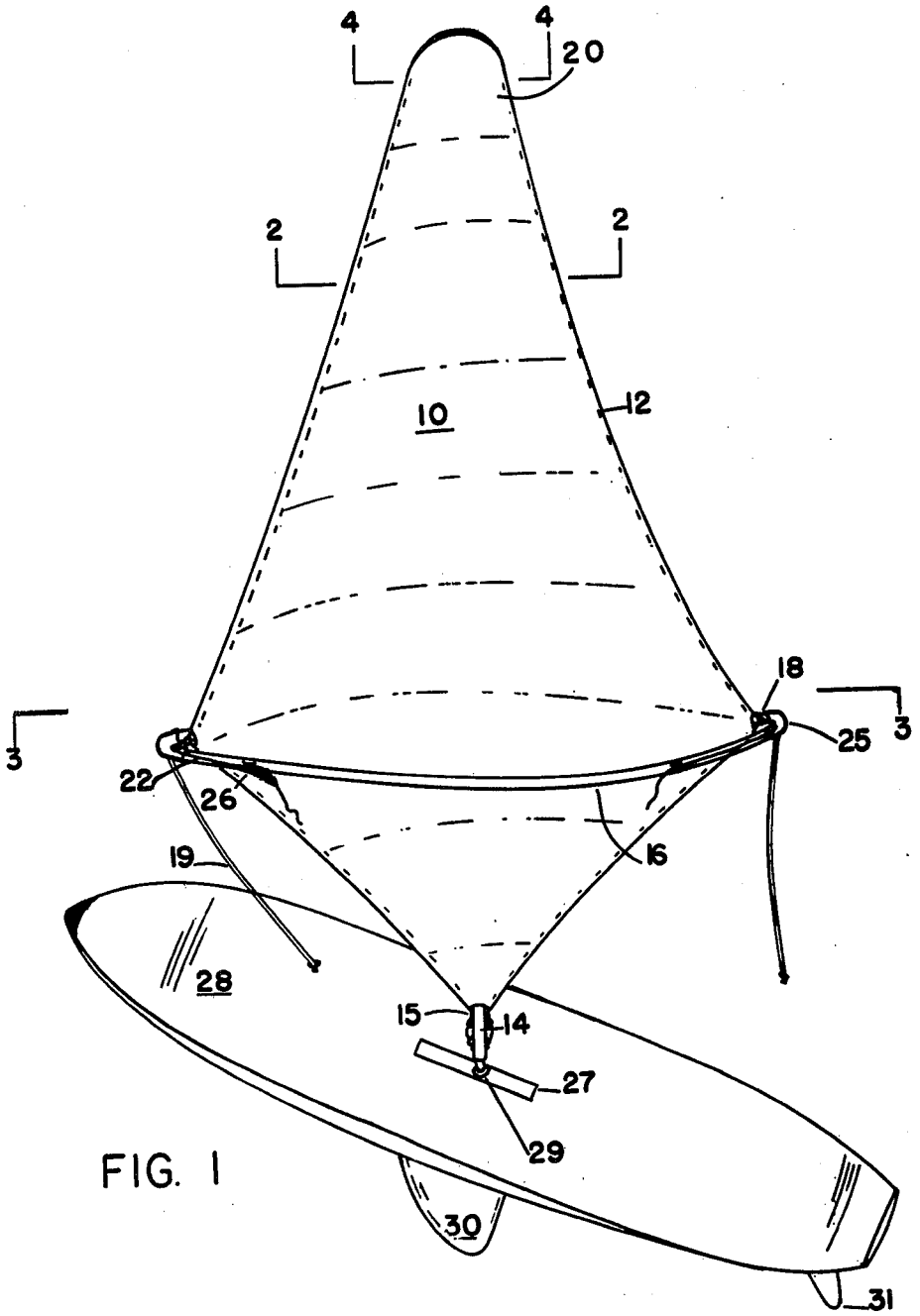
FIG. 1 is a perspective view of the preferred embodiment of the invention flexibly mounted on a sail board with a curved spar used as a hand holding device for stand up sailing.

The sail as shown in FIG. 1 is flexibly mounted to a sailboard 28 by a universal or flexible joint 29. A curved spar 16 is attached to the ends of curved boom 18 by a boom connector 25 and is used for hand holding control. The uphaul line 19 serves for erecting the sail, especially after it has fallen in the water.

The sailboard is equipped with a centerboard 30 centerboard well 29 and skeg 31 for hydrodynamic stability while underway. The universal joint can be mounted on the centerboard as in FIG. 1 or as preferred forward of the centerboard. Directional control is achieved by positioning the sail fore and aft longitudinally with respect to the centerboard.

A windward flexible sail section 10 is constructed of polyester or sailcloth and is located to windward of the internal boom 18 and internal mast 14 and is attached to a cable, or tension device 13 at the fore and aft edges of the sail section. The cable 13 is attached to the internal boom 18 near the outer ends. The attachment comprise a ring 43 attached to the edge tension cables 13 and an outhaul line 32. The outhaul line connects to the spar 16 and boom end 25 through a turning block 44 and jam cleat 42 for adjustable outhaul control to set the airfoil section for various wind conditions.

At the head or top of the sail the edge cables 13 are connected to the lower corners of a rigid mast head piece 20 in addition the sail forms a boot over and is supported by the mast head piece 20. The mast head piece is a spreader for the edge tension cables 13 and is supported by the mast 14. The sail forms an arch around the tip or top of the mast and thus a larger sail area and a lower mast is achieved. The vertical tension of the sail is adjusted by a pair of downhaul lines 56, one attached to an eye, cable loop, at the lower end of the edge cables 13 and is tied to the downhaul cleat 58 the other line through a grommet 54 at the base of the sail also tied off to the downhaul cleat 58, see FIG. 5.

Figure 4:
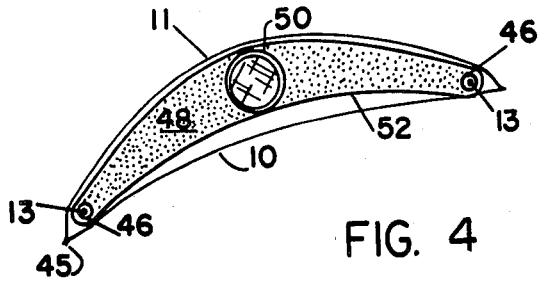
FIG. 4 is a sectional drawing on line 4—4 of FIG. 1 showing a crossection of the mast head device used for supporting the top of the sail.
Figure 2:
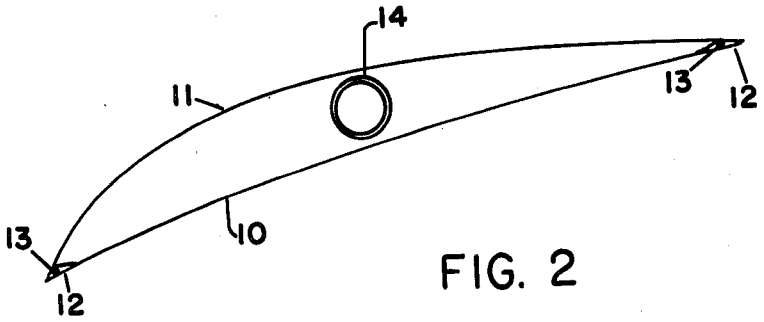
FIG. 2 is a sectional drawing on line 2—2 of FIG. 1 showing a crossection of the sail encompassing the mast.

The mast head piece, FIG. 4, has a foam core 48 for light weight and flotation, and a reinforced plastic skin 52 to add strength. A tube 46 is attached to the edge of the mast head piece 20. The edge cables 13 run in the tube and are fixed on either end to prevent sliding through the tube. A socket 50 within the lower end of the head piece 20 accomodates the upper end of the internal mast 14.

Figure 3:
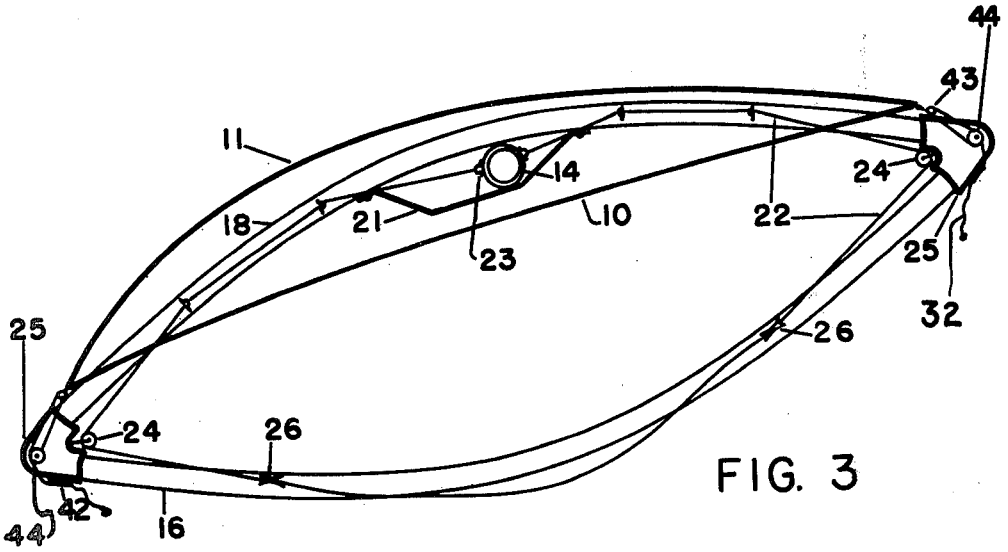
FIG. 3 is a sectional drawing on line 3—3 of FIG. 1 showing the internal mast boom arrangement and attachment to the external spar used for hand holding control of the sail.
Figure 6:
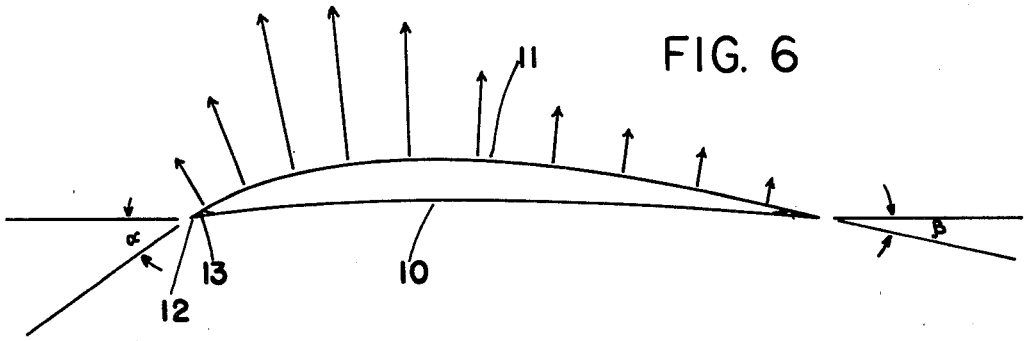
FIG. 6 is a diagrammatical illustration showing the preferred airfoil shape due to wind pressure distribution along the arc of the sail and the leading and trailing edge angle differential as a result.
Figure 7:
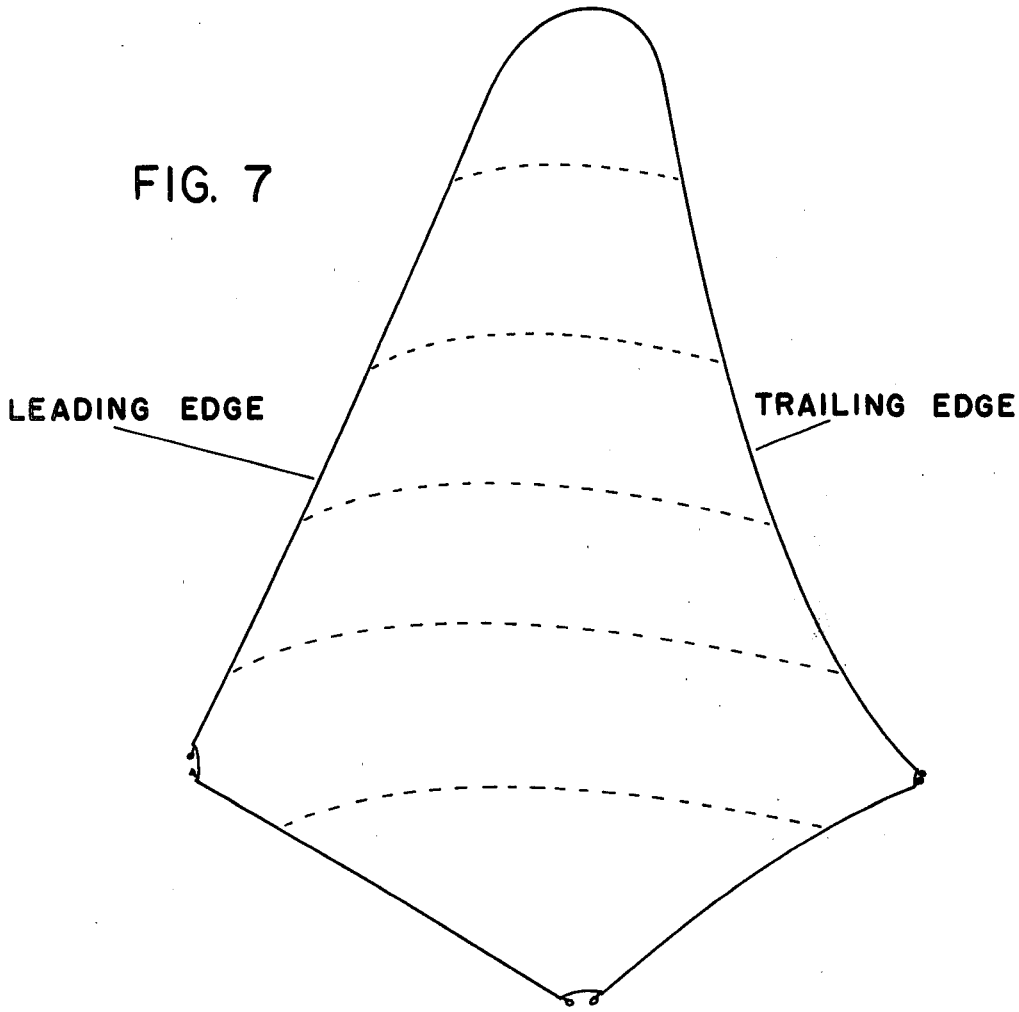
FIG. 7 is a perspective view of the sail showing the edge curves of the sail due to differential edge tensioning.
Figure 8:
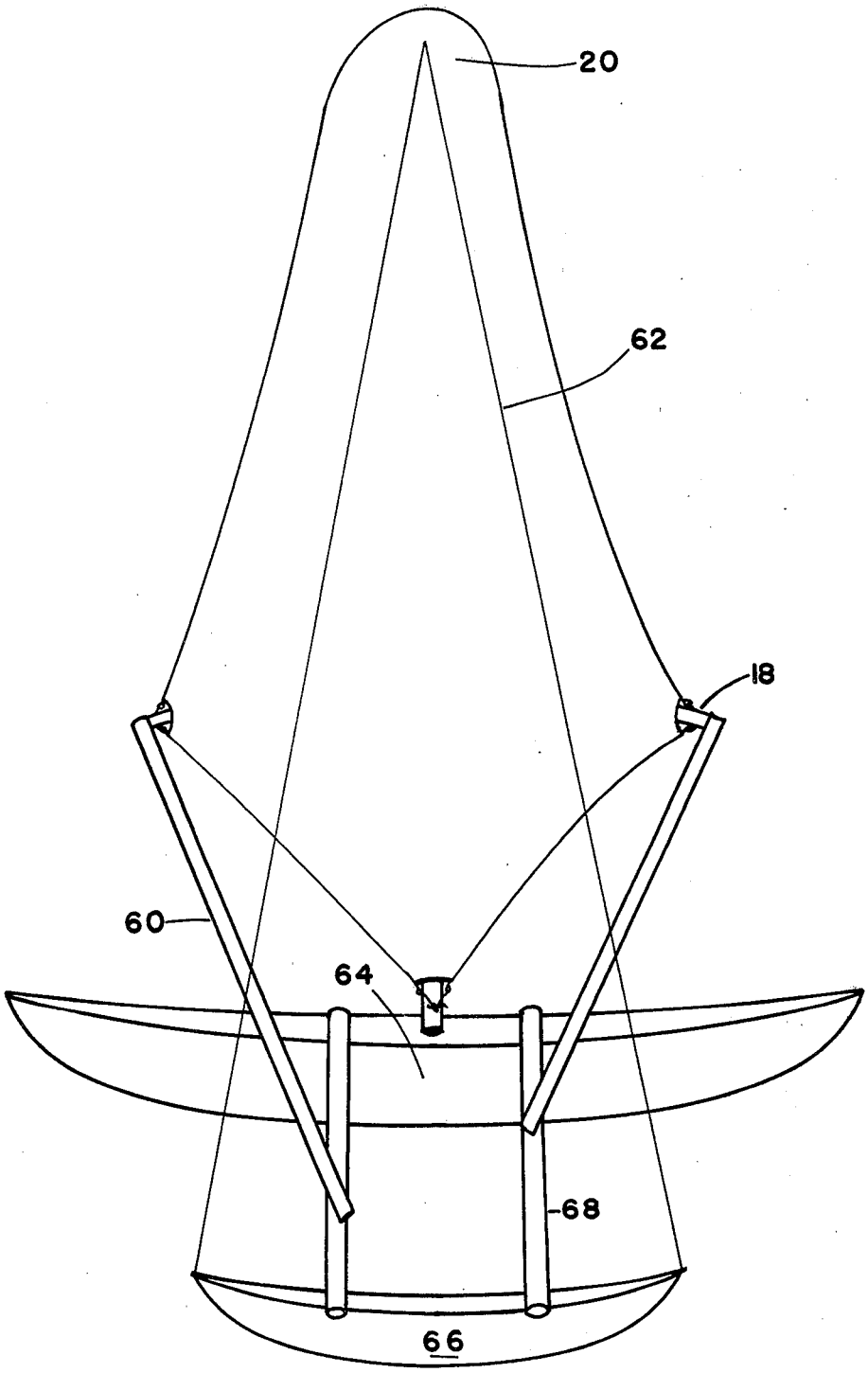
FIG. 8 is a perspective view of the invention mounted on a double ended proa for providing efficient motive power.

A second flexible section sailcloth is attached along its edge perimeter 45 to the edge cable pocket 12 of the windward sail 10 and has greater curvature than the windward sail 10. This second sail 11 hereby referred to as the leeward section, is located to leeward of the windward sail and encompasses the mast 14 and curved boom 18 is slideably attached to the mast 14 (see FIG. 3) and a control line 22 is used to adjust the mast position along the boom. The mast centrally located within the sail slides along the boom within a bracket 21 and is pulled by a control rope towards either end, the edge tension cables 13 attached to ends of the internal curved boom 18 are tensioned and loosened by the control of the mast position within the bracket 21 similar to the action of a bow and arrow. The leading edge has greater tension and the trailing edge has the lesser tension to form a more preferable airfoil section with the maximum curvature forward. The control line 22 effects the differential tension between the edge tension cables, the line is attached to the mast cleat 23 runs around block 24 and hand holding spar 16. The mast position is fixed by connecting the control line 22 through a jam cleat 26 at either end. Pulling the control line towards one side or the other and cleated off to form a preferred airfoil in either direction to control the reversal of the airfoil. The control device is not necessary for most flexible airfoils since the pressure distribution along the arc of the airfoil forces the maximum curvature forward, (see FIG. 6). Once the sail takes the preferred shape the control device will adjust the edge positions to compensate for the differing edge cable deflection angles, $\alpha$ and $\beta$, in FIG. 6. so that all twist of the sail is removed. The edges of the sail deflect along the leading and trailing angles of the airfoil, since the leading angle is greater than the trailing angle when the maximum curvature of the airfoil is forward, as in the preferred airfoil shape, then the leading edge should be tensioned to deflect less and the trailing edge slackened to deflect more in order to match the sidewards deflections so that there is no twist imparted to the airfoil, (see FIG. 6 & 7).

In another embodiment the sail as described is rotatably mounted on a double ended proa, this could be of much greater size than as described for boardsailing. A proa having a long hull 64 and a short hull 66 connected to the long hull by cross beams 68 to form an outrigger. The sail is mounted near the center of the long hull 64. A stay or guy wire 62 is attached to the windward side of the head piece 20 along the centerline of rotation and extends downward to a location on the outrigger hull 66 to increase the support for the sail. Control spars 60 are attached to the ends of the internal boom 18 on one end and is slideably attached to the cross beams 68 on the lower end. The position of the control spars 60 along the beams 68 is adjustable to effect sheeting angle control over the sail. The proa is sailed in the usual manner for reversing proas except the sail reverses airfoil direction without swinging the boom end to end. This embodiment is illustrative of one additional use for this invention. It is understood that this wing sail can be easily adapted to most any craft and the scope of this invention is not to be limited to the particular examples given.

METHOD OF OPERATION

Figure 5:
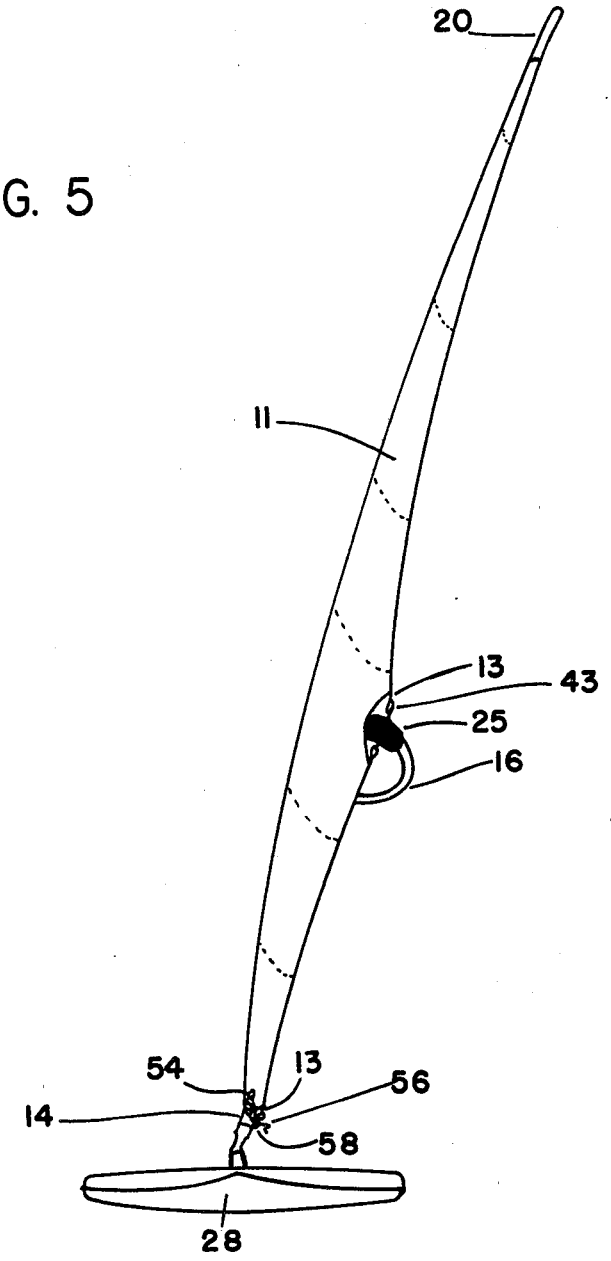
FIG. 5 is an edge on perspective view showing the leeward deflection of the sail and the position of the external boom for hand holding control.

To describe the use of the preferred embodiment reference is made to FIG. 1. and FIG. 5.

While sailing on one tack the operator holds on to the spar 16 with one hand forward and one hand aft and leans to windward to counter balance the wind force. By adjusting the inclination fore and aft directional control is achieved. This mode of operation is not unfamiliar to boardsailors. The distinction for reversible sails is in the area of tacking. Unlike the use of the conventional wishbone boom sail the operator always remains on the same side of the sail. Once the board is turned into the wind the sail is spun around by releasing the forward hand and pulling forward the after part of the sail with the aft hand while transfering in front of the mast to the other side of the board, the aft hand now being forward. In strong winds it is necessary to actually push the forward end of the sail off the wind to make the sail spin faster. Once this maneuver is completed the sail is inclined forward to head the board off the wind on the new tack.

Although the invention has been described with respect to particular illustrative embodiments, variations and modifications are possible within the inventive concept. In the first place, the term "universal joint", used with respect to the juncture of the foot of the mast with a sailboard, is used broadly, including a ball-and-socket joint or a gimbal joint, as well as the more common forms of universal joints. In other words, what is essential is that the attachment of the foot of the mast to a sailboard should permit variation of the inclination in any direction. Likewise, what has been referred to as the tension cable for the edges of the sail can be any kind of strong, flexible low-stretch strand. Thus, a braided prestretched polyester line would be useful, as would also a highly flexible wire cable. Furthermore, instead of separate cables for the two sets of edges at opposite ends of the airfoil chord of the sail and differential tensioning by shifting the boom, other systems are usable, the essential feature being that it should be possible to increase the tension on the edges of the sail at one end of the airfoil chord while reducing it for the edges of the sail at the other end of the airfoil chord. Conceivably, this might be done by slipping the corner of the sail on one side outward on the boom and on the other side, inward. There is even a possibility that the tension strands' effect could be provided by weaving-in stretched elastic strands lengthwise of the sail edges, rather than by fitting a line to run inside the joined edges of the windward and leeward webs of the sail.

I claim:

1. A flexible wing sail capable of cross-wind performance, reversible with respect to direction of air flow across the sail, and equipped with internal spars, comprising:

permanently windward and permanently leeward webs of flexible sheet material connected together at their edges and engaged there with tension strand means for extending said webs in wing sail form and for adjusting the airfoil profile to the reversible direction of air flow, said leeward web being of greater extent than said windward web in the general reversible direction of intended wind flow along the sail, so as to facilitate formation of an airfoil section having substantial thickness at its mid-portion; and spar means for supporting said tension strand means, said spar means including a mast and a leewardly convex curved boom adjacently crossing each other in the space between said webs and running at least for most of their respective lengths between said webs, said tension strand means being supported at or near opposite ends of said mast and of said boom.

2. A wing sail as defined in claim 1, in which the bottom end of said mast extends beyond the sail and is equipped with means for attachment to a sailboard permitting variation of the inclination of said mast to said sailboard in any direction.

3. A wing sail as defined in claim 1 or claim 2, further comprising a spar external to the sail on the windward side thereof for manipulation of the sail, having its ends affixed to said curved boom at or near opposite ends thereof.

4. A wing sail as defined in claim 1 or claim 2, further comprising means at the top of said mast for attachment of said tension strand means and for holding up the top end of said sail, constituted so as to provide a socket for said mast and for spreading apart the portions of said tension strand means serving the respective sail edges at opposite ends of the airfoil chord.

5. A wing sail as defined in claim 1 or claim 2, in which said tension strand means include separate strands for respectively serving the sail edges at opposite ends of the airfoil chord, each strand terminating near the top and bottom of the mast and being attached to said curved boom at or near one end thereof.

6. A wing sail as defined in claim 1 or claim 2, in which said boom is slidably attached to said mast for permitting said boom to be shifted longitudinally of the boom and cross-wise of the mast.

7. A wing sail as defined in claim 1 or claim 2, further comprising means for adjusting differential tension between sail edges respectively at opposite ends of the airfoil chord.

8. A wing sail as defined in claim 1 or claim 2, further comprising means for shifting said curved boom cross-wise with respect to said mast.

9. A wing sail as defined in claim 1 or claim 2, further comprising means for changing the differential tension between sail edges at opposite ends of the airfoil chord for reversing the airfoil section and for adjusting said differential tension, so as to minimize twist of the airfoil section along the height of the sail.

10. A wing sail as defined in claim 1 or claim 2, further comprising a spar external to the sail on the windward side thereof for manipulation of the sail and having its ends affixed to said curved boom at or near opposite ends thereof, and also means attached to said external spar for shifting the boom cross-wise with respect to said mast.

11. A wing sail as defined in claim 1, rigged for use on an outrigger type reversible sailboat on which said mast is mounted rotatably about an axis fixed with respect to said sailboat, said sailboat having at least two cross beams connecting the outrigger and main hull of said sailboat, and comprising control spars respectively connected to the ends of said internal curved boom of said sail and slidably attached to different ones of said cross beams for support and sheeting angle control of the sail.

* * * * *